United States Patent [19]

Akimoto et al.

[11] 4,124,357

[45] Nov. 7, 1978

[54] CATALYTIC CONVERTER OF A RADIAL FLOW TYPE

[75] Inventors: Tadao Akimoto, Toyota; Eiji Hiramatsu, Nukata, both of Japan

[73] Assignee: Toyota Jidosha Kogyo Kabushiki Kaisha, Toyota, Japan

[21] Appl. No.: 820,008

[22] Filed: Jul. 28, 1977

[30] Foreign Application Priority Data

Apr. 28, 1977 [JP] Japan ..... 52/54624

[51] Int. Cl.[2] ..... F01N 3/15; B01J 8/02

[52] U.S. Cl. ..... 422/181; 60/288; 60/299; 165/81; 55/DIG. 30; 422/179

[58] Field of Search ..... 23/288 F, 288 FA; 60/288, 299; 165/81; 55/DIG. 30

[56] References Cited

U.S. PATENT DOCUMENTS

| | | | |
|---|---|---|---|
| 3,649,214 | 3/1972 | Herariksson et al. | 23/288 F |
| 3,685,972 | 8/1972 | DePalma et al. | 23/288 F |
| 3,799,748 | 3/1974 | Scheitlin et al. | 23/288 F |
| 3,801,287 | 4/1974 | Scheitlin et al. | 23/288 F |

*Primary Examiner*—James H. Tayman, Jr.

*Attorney, Agent, or Firm*—Stevens, Davis, Miller & Mosher

[57] ABSTRACT

A catalytic converter of a radial flow type including an outer casing, a cylindrical outer separator, and a cylindrical inner separator, the two separators defining a catalyst chamber therebetween, wherein the end portions at one end of the two separators are firmly connected to the outer casing while the other end portions of the two separators are formed as mutually telescoping closed free ends having a radial and an axial clearance therebetween, these free end portions being flexibly supported from the outer casing by means of a plate element.

13 Claims, 2 Drawing Figures

CATALYTIC CONVERTER OF A RADIAL FLOW TYPE

BACKGROUND OF THE INVENTION

The present invention relates to a catalytic converter for processing gases and, more particularly, to a catalytic converter for use with automobiles for purifying exhaust gases from automobile engines.

Catalytic converters are often used in modern automobiles as a means for accomplishing purification of exhaust gases from engines. A catalytic converter for this purpose generally comprises a housing means having inlet and outlet ports and defining a gas flow passage extending therethrough from said inlet port to said outlet port, and a catalyst material such as grain catalyst charged in said housing means to be traversed by said gas flow. The catalyst material is of an oxidizing type in some cases while it is of a reducing type in other cases. Furthermore, a 3-way catalyst having oxidizing and reducing performance is also known and used.

In automobiles, a catalytic converter is incorporated at a middle portion of an exhaust system of an engine, and is traversed by hot exhaust gases. Therefore such a catalytic converter is liable to become hot during operation. Especially when a catalytic converter is of an oxidizing type, the bed of catalyst becomes relatively hot and, consequently, the casing, the separators for holding pellets of catalyst, and other structural members forming the housing of the converter also become relatively hot. Because of this high temperature condition to which the housing structural members are subjected, it is desirable that the structural members, particularly the separators, which are heated to the highest temperature of all, should be designed to be able to undergo relatively free thermal expansion and contraction.

A catalytic converter of a radial flow type includes a housing which generally comprises an outer casing, an outer separator formed as a cylindrical element having a large number of small openings and mounted in said outer casing so as to define an outer chamber between said outer casing and said outer separator, an inner separator formed as a cylindrical element having a large number of small openings and mounted in said outer separator so as to define an annular intermediate chamber between said outer and inner separators while defining an inner chamber at the inside thereof, a first port means connected with said outer chamber, and a seocnd port means connected with said inner chamber, wherein said outer and inner separators are supported by said outer casing. In such a housing structure for a catalytic converter, it is required that the outer and inner separators should be supported by the outer casing in a manner such that the separators are capable of thermally expanding and contracting relatively freely with respect to the outer casing. Furthermore, it is also required that the outer and inner separators be capable of thermally expanding and contracting relatively freely with respect to each other.

SUMMARY OF THE INVENTION

It is therefore the object of the present invention to provide a catalytic converter of a radial flow type having a housing means comprising the aforementioned structural members, wherein the outer and inner separators are adapted to be capable of thermally expanding and contracting relatively freely with respect to the outer casing as well as with respect to each other, thereby having an improved durability due to the lowering of thermal stress in the structural members.

Another object of the present invention is to provide a housing means for a catalytic converter of the above-mentioned kind.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENT

Figure 2:
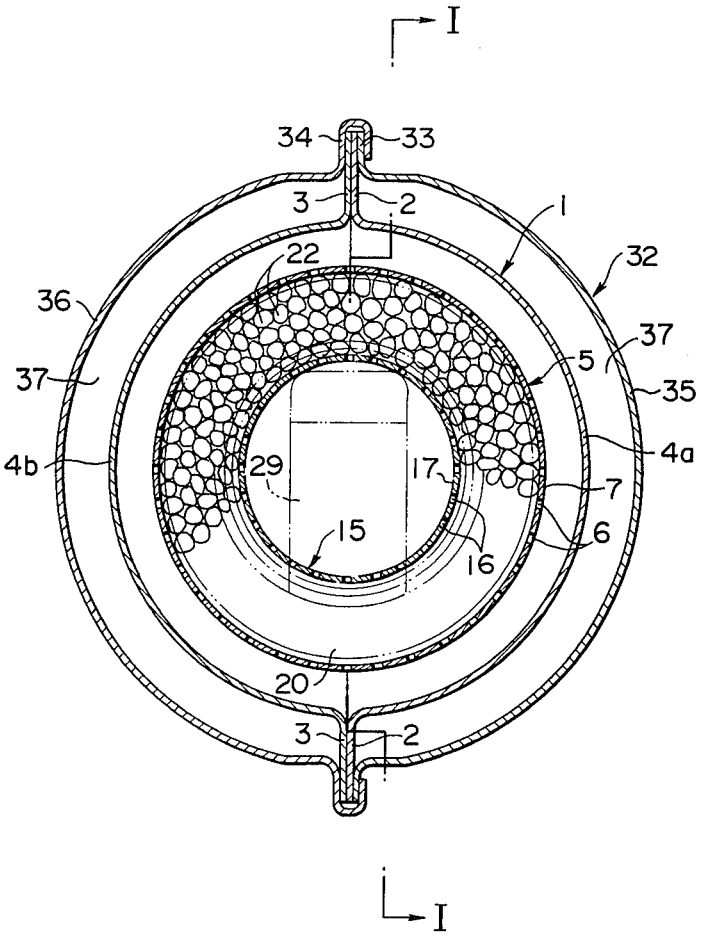
FIG. 2 is a cross-sectional view along line II–II in FIG. 1.

Turning now to the drawings, 1 designates an outer casing, made of a heat-resistant material such as stainless steel or other oxygen-resistant high temperature alloy, and formed as a cylindrical element having openings at opposite ends. As shown in FIG. 2, the outer casing 1 is made of an assembly of two semi-cylindrical shell elements 4a and 4b, having flange portions 2 and 3, respectively, at opposite edges thereof, said shell elements being connected with each other at the flange portions 2 and 3, where they are welded together.

Figure 1:
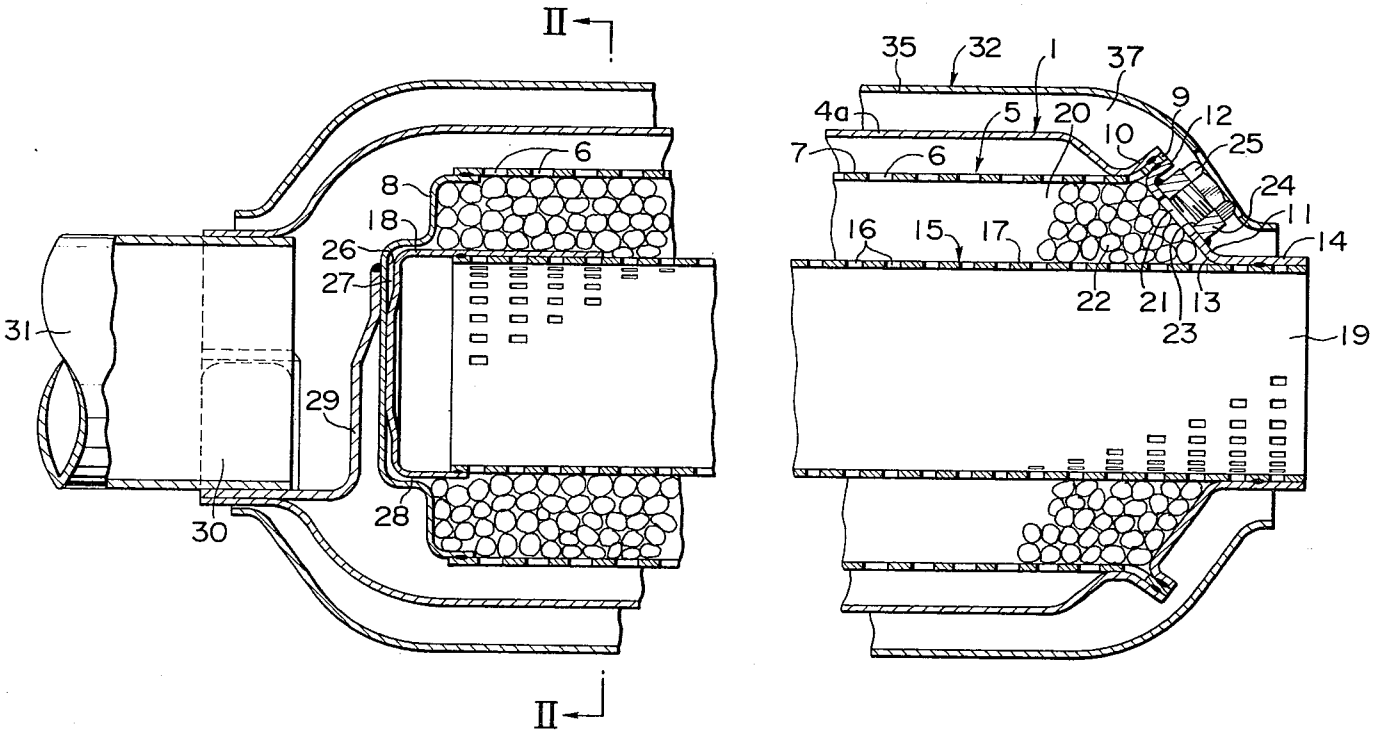
FIG. 1 is a longitudinal sectional view showing an embodiment of a catalytic converter of a radial flow type constructed according to the present invention.

Within the outer casing 1 is mounted an outer separator 5 made of a cylindrical shell 7 having a large number of slit openings 6 and and end cap 8 which closes an open end (left end in FIG. 1) of the cylindrical shell. The other end (right end in FIG. 1) 9 of the cylindrical shell 7 meets the open right end portion 10 of the outer casing 1 and is firmly connected therewith by welding or other suitable connecting means. The right open end 9 of the outer separator 5 also meets the annular peripheral edge portion 12 of a funnel-shaped end cap 11 and is firmly joined therewith by welding or other suitable connecting means. The end cap 11 has a conical portion 13 and a tubular end portion 14 which receives an end portion of a cylindrical inner separator 15. The inner separator 15 is made of a cylindrical shell 17 having a large number of slit openings 16 and an end cap 18 which closes an open end (left end in FIG. 1) of the cylindrical shell 17. The inner separator 15 is positioned in the outer separator 5 to be coaxial with respect to the outer separator. The right end portion of the cylindrical shell 17 forming the inner separator is firmly connected to the tubular portion 14 of the end cap 11 at their engaged portions by welding or other suitable connecting means and, in this manner, the right end portion of the inner separator is firmly supported by the outer casing 1 by way of the end cap 11. The right open end of the cylindrical shell 17, together with the tubular portion 14 of the end cap 11, defines a gas outlet port 19. The outer and inner separators 5 and 15 define therebetween an intermediate chamber 20 which is filled with pellets of catalyst 22 charged therein through a catalyst supply port 21 formed in the conical portion 13 of the end cap 11. The catalyst supply port 21 is provided with a retainer 24 having a threaded opening 23 in which is mounted a plug bolt 25.

The left end cap 8 of the outer separator 5 is formed in the shape of a cap including a central recess 26 having a substantially cylindrical side wall. The central recess 26 is adapted to receive the end cap 18 of the inner separator 15. Between the central recess 26 and the end cap 18 an axial clearance is provided for allowing the inner separator to expand thermally in the axial direction with respect to the outer separator, and there is also provided an annular clearance 28 which allows the end cap 18 of the inner separator to expand thermally in the radial direction with respect to the end cap 8 of the outer separator. The annular clearance 28 is so dimensioned that the pellets of catalyst cannot enter into the space.

The end cap 8 of the outer separator 5 is supported from the outer casing 1 by way of a flexible support plate element 29 which is connected to said end cap 8 at one end thereof and is connected to the outer casing 1 at the other end thereof. In the embodiment shown in FIG. 1, the support plate element 29 is an L-shaped element to have a flexibility which allows for a certain relative displacement between its opposite ends, one being connected to the end cap 8 by welding while the other is connected to the outer casing 1 by welding or other suitable connecting means. The support plate element 29 allows the end cap 8 to shift for a certain amount in radial and axial directions due to its thermal expansion and contraction. As is obvious from the structure shown in FIG. 1, the support plate element 29 allows for an easier axial then radial displacement of the end cap 8.

A front pipe 31 is connected to the gas inlet port 30 of the outer casing 1, said front pipe in turn being connected to an exhaust system of an engine not shown in the figure. The outer casing 1 is covered by an insulating cover 32 which is an assembly of two semi-cylindrical shell elements 35 and 36 having flange portions 33 and 34 by which they are mounted to the flange portions 2 and 3 of the outer casing, as shown in FIG. 2. The outer casing 1 and the insulating cover 32 define therebetween an annular heat insulating chamber 37 which may be a vacant space or may be filled with a suitable heat insulating material.

In operation, the exhaust gases conducted through the front pipe 31 are introduced through the gas inlet port 30 into an annular outer chamber defined between the outer casing 1 and the outer separator 5, wherefrom the gases flow through the slit openings 6 into an annular intermediate chamber 20 which is defined between the outer separator 5 and the inner separator 15 and is filled with the pellets of catalyst 22. The gases flow radially inwardly through the spaces left among the pellets, as well as through the porous structure of the pellets, and reach the inner separator 15 where the gases flow through the slit openings 16 formed in the inner separator, so as to be collected in an inner chamber provided at the inside of the inner separator 15, wherefrom the gases are exhausted through the gas outlet port 19. While the exhaust gases flow through the layer of the pellets of the catalyst 22, they are affected by the catalytic action of the catalyst so that noxious components contained in the exhaust gases are rapidly oxidized or reduced, thereby converting them into non-noxious components.

During operation, the structural elements of the converter, particularly the outer and inner separators 5 and 15, are heated up to a relatively high temperature by hot exhaust gases. Particularly when an oxidising reaction of noxious components is effected in the bed of catalyst, the outer and inner separators 5 and 15 are heated up to a substantially higher temperture compared to the temperature of outer casing 1. Furthermore, since in this case the gases leaving the bed of catalyst through the slit openings 16 formed in the inner separator 15 are hotter than the gases entering into the bed of catalyst through the slit openings 6 formed in the outer separator 5, the inner separator 15 becomes hotter than the outer separator 5 and undergoes thermal expansion with respect to the outer separator. Such thermal expansions of the outer and inner separators with respect to the outer casing and of the inner separator with respect to the outer separator are permitted in the converter housing of the present invention by the outer and inner separators expanding leftward in the figure from their firmly connected right end portions while flexibly deforming the support plate element 29, as well as by the end cap 18 of the inner separator being more deeply engaged into the central recess 26 of the end cap 8 of the outer separator while reducing the axial clearance 27 provided therebetween. By the aforementioned arrangement for absorbing thermal expansions of the outer and inner separators, they are relieved from any high thermal stress and are ensured of a long life of operation.

Although the invention has been shown and described with respect to a preferred embodiment thereof, it should be understood by those skilled in the art that various changes and omissions of the form and detail thereof may be made therein without departing from the scope of the invention.

We claim:

1. A catalytic converter of a radial flow type comprising an outer casing, an outer separator formed as a cylindrical element having a large number of small openings and mounted in said outer casing so as to define an outer chamber between said outer casing and said outer separator, an inner separator formed as a cylindrical element having a large number of small openings and mounted in said outer separator so as to define an annular intermediate chamber between said outer and inner separators while defining an inner chamber at the inside thereof, a first port means connected with said outer chamber, a second port means connected with said inner chamber, said outer and inner separators having first end portions firmly connected with said outer casing and mutually telescoping closed second ends, an L-shaped flexible support plate element having a first end portion connected with said outer casing and a second end portion connected with said second end portion of said outer separator, thereby directly supporting said second end portion of said outer separator from said outer casing in radial and axial directions while permitting relative displacement of the outer separator with respect to the outer casing both in the radial and the axial directions so as to relieve thermal stress, and catalyst material charged in said annular intermediate chamber.

2. The catalytic converter of claim 1, wherein said catalyst material has the shape of pellets having a larger diameter than said small openings formed in said outer and inner separators.

3. The catalytic converter of claim 2, wherein said mutually telescoping closed seconds ends of said outer and inner separators define an annular clearance therebetween which is smaller than the diameter of said pellets.

4. The catalytic converter of claim 1, wherein said catalyst material is an oxidizing catalyst, said mutually telescoping closed second ends of said outer and inner separators defining an axial clearance therebetween so that said inner separator can expand with respect to said outer separator so as to reduce said axial clearance when exhaust gases containing uncombusted components are passed through the catalytic converter to traverse said annular intermediate chamber containing said catalyst material from said outer chamber to said inner chamber.

5. The catalytic converter of claim 1, wherein said outer separator includes a funnel-shaped end cap having a frusto conical portion and a catalyst supply port means provided in said frusto conical portion for charging and discharging said catalyst material into and out of said intermediate chamber therethrough.

6. A catalytic converter housing of a radial flow type comprising an outer casing, an outer separator formed as a cylindrical element having a large number of small openings and mounted in said outer casing so as to define an outer chamber between said outer casing and said outer separator, an inner separator formed as a cylindrical element having a large number of small openings and mounted in said outer separator so as to define an annular intermediate chamber between said outer and inner separators while defining an inner chamber at the inside thereof, a first port means connected with said outer chamber, a second port means connected with said inner chamber, said outer and inner separators having first end portions firmly connected with said outer casing and mutually telescoping closed second ends, and an L-shaped flexible support plate element having a first end portion connected with said outer casing and a second end portion connected with said second end portion of said outer separator, thereby directly supporting said second end portion of said outer separator from said outer casing in the radial and the axial directions while permitting relative displacement of the outer separator with respect to the outer casing both in the radial and the axial directions so as to relieve thermal stress.

7. The housing of claim 6, wherein said mutually telescoping closed second ends of said outer and inner separators include end caps, the end cap of said outer separator having a central recess in which the end cap of said inner separator is telescopingly engaged.

8. The housing of claim 7, wherein said outer and inner separators are so dimensioned that a radial clearance and an axial clearance are left between the end cap of said inner separator and the central recess of said end cap of said outer separator when the housing is at ambient temperature.

9. The housing of claim 6, wherein said outer casing includes two semi-cylindrical elements having opposite longitudinal flange portions, said two elements being joined together at said opposite flange portions to provide a cylindrical structure of said outer casing.

10. The housing of claim 9, further comprising an insulating cover including two semi-cylindrical elements having opposite longitudinal flange portions which are mounted to said flange portions of said outer casing thereby constructing a cylindrical shell structure of said insulating cover.

11. The housing of claim 6, wherein said outer separator includes a cylindrical portion having an annularly flanged end portion and a funnelshaped end cap having an annularly flanged edge portion, a conical intermediate portion and a tubular inner end portion, said annularly flanged end portion of said cylindrical element being connected with said annularly flanged edge portion of said end cap while said tubular inner end portion of said end cap receives said inner separator formed as a cylindrical element.

12. The housing of claim 11, wherein said outer casing includes an annularly flanged edge portion which is connected with said annularly flanged edge portion of said cylindrical element forming said outer separator.

13. The housing of claim 11, wherein said conical intermediate portion of said end cap includes a port means having an opening, an internally threaded retainer means and a plug bolt screwed into said retainer means.

* * * * *